US005726131A

United States Patent [19]

Froeschmann

[11] Patent Number: 5,726,131

[45] Date of Patent: Mar. 10, 1998

[54] LUBRICANT OR LUBRICANT CONCENTRATE

[76] Inventor: Erasmus Froeschmann, Heinrich-Drewes-Strasse 10a, D-2800 Bremen 61, Germany

[21] Appl. No.: 449,083

[22] Filed: May 24, 1995

Related U.S. Application Data

[63] Continuation of Ser. No. 216,074, Mar. 21, 1994, abandoned, which is a continuation of Ser. No. 33,966, Mar. 19, 1993, abandoned, and Ser. No. 663,182, Feb. 26, 1991, abandoned, which is a continuation-in-part of Ser. No. 294,603, Jan. 30, 1989, abandoned.

[30] Foreign Application Priority Data

Apr. 10, 1987 [DE] Germany ..... 37 12 134.0

[51] Int. Cl.[6] ..... C10M 141/10; C10M 141/08

[52] U.S. Cl. ..... 508/271; 508/364; 508/365; 508/579

[58] Field of Search ..... 508/271, 264, 508/365, 579

[56] References Cited

U.S. PATENT DOCUMENTS

| | | | |
|---|---|---|---|
| 2,580,274 | 12/1951 | Bergstrom et al. | 252/33.4 |
| 2,898,299 | 8/1959 | Lowe | 252/52 R |
| 3,476,685 | 11/1969 | Oberender et al. | 252/52 R |
| 3,533,943 | 10/1970 | Papayannopaulos | 252/32.7 E |
| 3,717,611 | 2/1973 | Baumer et al. | 252/52 R |
| 3,801,540 | 4/1974 | Dexter et al. | 252/56 R |
| 3,859,318 | 1/1975 | LeSuer | 252/56 R |
| 4,374,282 | 2/1983 | Maldonado et al. | 252/52 R |
| 4,652,385 | 3/1987 | Cohen | 252/49.8 |
| 4,705,879 | 11/1987 | Dressler | 252/49.8 |
| 4,789,492 | 12/1988 | Katsumata | 252/32.7 E |
| 4,801,391 | 1/1989 | Goldblatt et al. | 252/32.7 E |
| 4,842,755 | 6/1989 | Dunn | 252/32.7 E |

OTHER PUBLICATIONS

Pitzer and Brewer, Thermodynamics, 1961, Chapter 4, p. 37.

*Primary Examiner*—Jerry D. Johnson
*Attorney, Agent, or Firm*—Ladas & Parry

[57] ABSTRACT

Lubricant or lubricant concentrate on mineral oil and/or synthetic oil basis having improved lubricating properties, in particular improved load bearing, sliding and corrosion inhibiting properties, which contains a) one or more mineral oils and/or synthetic oils as base oil and b) at least one tetravalent to octavalent alcohol having at least one quaternary carbon atom as well as at least one ether bond in its molecule and having a density $d_{20}$ of at least 0,900, and an enthalpy H of at least 350 kcal/kg, c) at least one asymmetric, organometallic compound, d) at least one phosphor containing substance, e) at least one sulfur containing substance and f) further usual additives.

36 Claims, No Drawings

LUBRICANT OR LUBRICANT CONCENTRATE

This is a continuation of application Ser. No. 08/216,074 filed on Mar. 21, 1994, now abandoned, which is a continuation of Ser. No. 08/033,966 filed on Mar. 19, 1993, now abandoned, and a continuation of Ser. No. 07/663,182 filed on Feb. 26, 1991, now abandoned, which is a continuation-in-part of Ser. No. 07/294,603 filed Jan. 30, 1989, now abandoned.

DESCRIPTION

The present invention refers to a novel lubricant (lubricating agent) or lubricant concentrate on a mineral oil and/or synthetic oil basis having improved lubricating properties, in particular improved load bearing, sliding or gliding as well as corrosion preventing properties.

During the last decades numerous processes and lubricating systems have been developed in order to reduce the friction and wear of moving machine parts and to lower the costs for energy and replacement parts and to extend the service life of lubricants and of materials. As an ideal lubricant the "lifetime lubricant" is considered which takes into account the ecological requirements becoming more and more restrictive.

On the way to longlife and hi, duty lubricants, lubricating systems and lubricating processes in the first step the so-called chemical wear lubrication has been developed. By using it the metal-to-metal contact could be largely prevented by means of the salt formation on the surfaces of the micro-mountains of the moving parts by forming chemically reactive cover coats on the surfaces or by introducing chemically reactive compounds into the base lubricants. In this manner the seizing of the machine parts could be prevented. But simultaneously the wear by shearing of the salt coats between the metal parts moving against one another has been promoted. The service life of the materials therefore remained relatively short. In a further step solid lubricants have been developed which were introduced between the moving metal parts such as graphite, $MoS_2$, $TiO_2$, $Ca_3(PO_4)_2$, teflon etc., which were introduced in the form of lubricating cover coats, suspensions, pastes or fats. In this way the frictionating parts were better separated from each other and their loadability was increased. However, the solid lubricants and base media are separated from each other sooner or later under the influence of centripetal movements of higher circumference speeds and at a higher temperature due to their different specific densities. The longlife lubrication is limited thereby. In a further step the deposition of suitable metal cations out of chemical complexes dissolved in a lubricant onto the frictionating surfaces in operation has been achieved. There under the pressure and the temperature of the frictionating parts they form eutectica together with the metal border layers, which fill up smoothingly the roughness valleys and flatten in part tribochemically in part microplastically the roughness peaks. The anionic part of the organometallic compounds forms in situ lubricating and adhering reaction layers on the newly rebuilt eutectoid frictional faces.

Besides a starting phase which is too long, a friction coefficient and a wear which are too high, the control of the reaction proceeding is a problem with these lubricating systems. Either material-independent eutectica and reaction layers are achieved which do no more function sufficiently as agents for removing the minute unevennesses due to the preparation of the workpieces in narrow fittings so that at these places overload areas and resulting later metal breaks at the sliding faces occur, or the aggressive component of the organometallic compounds is strengthened and this results in the phase of chemical wear lubrication leading to too high removing rates and to a too short life service.

For example, from DE-PS 941 678 lubricating oils having a content of soluble reaction products of phosphorus pentasulfide and liquid or solid aliphatic hydrocarbons or terpene hydrocarbons are known. From DE-PS 923 984 there is known a lubricating oil which contains the metal containing alkylphenolsulfide esters in combination with zinc sulfonates. From DE-AS 1 444 892 there is known a lubricating oil which contains a salt of an aromatic zinc dithiophosphate and a zinc carboxylic acid salt in the presence of water. While both formerly stated products are lubricating oil detergents the latter product is said to prevent the corrosion of silver bearing surfaces. From DE-AS 1 296 730 there is known a lubricating oil which contains a substituted succinic acid optionally together with a salt of an alkylated or esterified phosphoric acid. This product is an antioxidant functioning as detergent. From DE-AS 1 271 878 there is known a combination of dithiophosphate and dithiophosphinate salts. From DE-OS 15 94 555 there are known cutting oils which contain free sulfur, a dialkyldithiophosphate and a chlorinated hydrocarbon. In U.S. Pat. No. 3,462,367 lubricating oils containing a zinc or antimony dithiocarbamate are disclosed. From U.S. Pat. No. 2,758,087 lubricating oils are known, containing a sulfur-phosphorus-compound prepared by reacting phosphorus pentasulfide with an olefin at a higher temperature, and zinc phthalate. However, all these known lubricating oil additives do not fulfill the today's requirements, in particular they lead to heavy oxidic deposits in the area of the lubricating place and cause a wear which is too high.

From U.S. Pat. No. 2,734,865 it is known to use a lubricating oil additive which is formed of a dithiophosphate of the alkaline earth metal salts in combination with a complex reaction product of phosphorus sulfides, tallow oil fatty acid alcohol esters, zinc chloride and barium hydroxide. The friction coefficients and wear values which can be achieved therewith are too high for today's requirements and furthermore the face pressure value is too low. From U.S. Pat. No. 2,734,864 lubricating oil additives are known which are formed of a dithiophosphate of the alkaline earth metals in combination with a complex reaction product of phosphorus sulfides, wool fat and alcohol esters. The undefined product contains substantial amounts of barium and zinc. Such a lubricating oil additive is not usable in practice because of its inbearable odor which also jeopardizes the health of the operators getting in contact with it. From DE-PS 1 954 452 lubricants on mineral oil and synthetic oil basis are known which contain besides the mineral oil or synthetic oil as additives an ester of an epoxidized fatty acid having 10 to 18 C-atoms and of a monovalent or multivalent alcohol, an alkyl, aralkyl or aryldithiophosphate of zinc, lead, tin, tungsten, molybdenum, niobium or lanthanum, and optionally a sulfur-phosphorus-compound. From DE-PS 2 108 780 lubricants on the basis of a mineral oil or synthetic oil and lubricant concentrates, respectively, are known which besides a lead, tungsten, molybdenum and/or vanadium dithiophosphate esterified with alkyl, aryl or aralkyl groups contain in addition at least one zinc dialkyldithiophosphate compound and a sulfur-phosphorus-compound which is free of a metal. Also these latter lubricants which have found a widespread use, do no more fulfill all requirements of modern longlife and high duty lubricants. Their friction coefficient and wear are too high, their storage restistance is insufficient, their longlife use leads to a too high reclamation quote in the lubricant field.

The object of the present invention is to provide a novel lubricant (lubricating agent) or lubricant concentrate on a mineral oil or synthetic oil basis having improved lubricating properties, in particular improved friction and wear properties and reduces sensibly the need of energy and replacement parts and meets the highest requirements.

It has now been found that this object according to the present invention can be surprisingly reached by adding at least one tetravalent to octavalent alcohol containing in its molecule at least one quaternary carbon atom and at least one ether bond and having a density $d_{20}$ of at least 0,900 and an enthalpy H of at least 350 kcal/kg, at least one asymmetric organometallic compound, at least one phosphorus containing substance and at least one sulfur containing substance to a mineral oil and/or synthetic oil besides the usual additives.

The subject of the present invention is a novel lubricant or lubrical concentrate on mineral oil and/or synthetic oil basis which is characterized in that it contains a) one or more mineral oils and/or synthetic oils as base oil and b) at least one tetravalent to octavalent alcohol having at least one quaternary carbon atom as well as at least one ether bond in its molecule and having a density $d_{20}$ of at least 0,900 and an enthalpy H of at least 350 kcal/kg, c) at least one asymmetric organometallic compound, d) at least one phosphor containing substance, e) at least one sulfur containing substance and f) further usual additives.

The lubricants and lubricant concentrates of the invention are superior to the known lubricants and lubricant concentrates in particular in regard to their friction and wear properties and reduce substantially the need of energy and replacement parts. It is assumed that this is due to the fact that by their use in the friction and slide areas metallic glass surfaces consisting of amorphous solidified metal melts are formed which do not exhibit any metal crystal lattice structures. The glass-like smooth friction and sliding surfaces which are believed to be formed by using the lubricants or lubricant concentrates of the present invention improve substantially the whole lubricating process since the friction coefficient and the wear, the oxidation and the corrosion are reduced substantially. Also the so-called fitting-rust is prevented by the lubricant and lubricat concentrate of the invention. In addition, the lubricants and lubricant concentrates of the invention are non-polluting since they do not contain any lead, no sulfur containing whale sperm oil and almost no phosphorus. This has been shown in fish tests and bacterial cultivation tests which have been carried out with the lubricants and lubricant concentrates of the invention. Furthermore, it has been shown that they are degradable biologically in normal soil within 3 to 4 months to an extent of 60%. Thus, they can be considered as extremely non-polluting. In particular they are suited for the use in homokinetic joints for vehicles, i.e. small joints subject to a high number of revolutions and a high load, and they are more similar to the ideal lubricant "lifetime lubricant" than all other already known lubricants. Additionally, the polyolether compounds having quaternary carbon atoms which are used according to the present invention have a significant thermal stability and enable the utilization of high operating temperatures of up to 300° C. They offer the possibility to use them as lifetime lubrication of high duty engines, turbines, roller bearings, synchronizing joints and other high duty machine elements.

The expression "lubricant or lubricant concentrate on mineral oil and/or synthetic oil basis" used in the present application is meant to comprise lubricating oils as well as lubricating fats on mineral oil and/or synthetic oil basis.

The expression "quaternary carbon atoms containing compounds" used here is meant to comprise those compounds wherein the 4 main valences of at least one carbon atom per molecule are each substituted by 4 carbon atoms. Examples for such compounds are monomeric, dimeric and trimeric pentaerythritolethers, other polyolethers, pentaerythritol ethoxyethers as well as telomeric acid pentaerythritolethers and the corresponding ethoxylated ethers.

As can be seen from the examples following below the lubricants and lubricant concentrates of the invention have substantially improved properties compared with the known lubricant and lubricant concentrates. The glass-like smooth friction and sliding faces formed by the lubricant of the invention save driving energy and reduce the friction coefficient per se and also by the formation of a very good adhering boundary lubricating film which enables an elastohydrodynamic lubrication also with a point-like load. This results in a lowering of the friction temperature of the lubricant and of the lubricated place, in an extension of the oxidation resistance of both and the metallic friction partners are less subjected to specific change-load and temperature stresses.

In summary, the wear is extremely lowered by these effects and the service life of the friction partners and of the lubricant is extended sensibly. According to the present invention these improvements are achieved within a very broad viscosity range so that now oils having a low viscosity can also be used in those fields where until now the use of oils having high or intermediate viscosity values have been considered as being indispensable, for example in gears, differential gears, or gears of turbines. In addition the thermal stability of the lubricant and lubricant concentrate of the invention allows its use in lubricating places subjected to high operation temperatures, such as in Diesel engines and aircraft turbines.

According to a preferred embodiment of the invention the lubricant or lubricant concentrate contains as component (b) a mono-, di- or tripentaerythritol the hydroxyl group(s) of which is (are) etherified or ethoxyetherified by a straight or branched alkyl, aralkyl or aryl group having 6 to 18 carbon atoms, preferably 6 to 12 carbon atoms, especially 8 to 12 carbon atoms.

According to a further preferred embodiment of the invention it contains as component (b) a mono-, di- or tetraether of pentaerythritol.

According to a preferred embodiment of the invention the lubricant or lubricant concentrate of the invention contains additionally a component having at least one free hydroxyl group.

According to a preferred embodiment of the invention the lubricant or lubricant concentrate contains the component (b) in an amount of from 0,1 to 40% by weight, preferable 0,1 to 20% by weight, in particular 1 to 12% by weight, especially 2 to 6% by weight, based on the weight of the mineral oil and/or synthetic oil.

According to a further preferred embodiment of the invention the lubricant or lubricant concentrate of the invention contains as component (b) an ether derivative and/or an ethoxylated ether derivative of mono-, di- or tripentaerythritol and/or a telomeric acid pentaerythritol ether or an ethoxylated derivative thereof. The lubricant or lubricant concentrate of the invention contains as base oil preferably beet oil, natural oil and/or a synthetic oil having a viscosity in the range of from 1,0 mPa.s at 20° C. to $2.10^6$ mPa.s at 20° C. Particularly preferred is the use of a mineral oil having a viscosity of from 1,0 mPa.s at 20° C. to 540 mPa.s at 50° C. as natural oil and the use of an aromatic or aliphatic dicarboxylic acid ester, in particular of a poly-α-olefin-dicarboxylic acid ester, especially -butylester, having a molecular weight in the range of from 1000 to 3000, preferably the use of phthalic acid diisodecylester, trimethyladipic acid didecylester and sebacic acid dioctylester, a polyisobutylene having a molecular weight of from 1000 to 100 000 and a viscosity of from 200 to 43 000 mPa.s at 100° C., of a polymethacrylate having a viscosity of 1000 mPa.s at 100° C., of a water insoluble polyglycol having a viscosity of from 5 to 60 mPa.s at 100° C., of an isoparaffin oil and/or alkylbenzene having an inflammation point of more than 50° C. and a viscosity in the range of from 1,0 mPa.s at 20° C. to 2 000 000 mPa.s at 20° C. and of a telomeric acid ester, preferable a neopentylglycol and/or trimethylolpropane ester of the telomeric acid.

As further additive the lubricant or lubricant concentrate of the invention preferably contains a sulfur containing substance, in particular a thiazole, at least one metaldialkyldithiocarbamate and/or a metaldialkyldithiophosphate and/or a phosphorus containing substance, in particular an organophosphite, preferably a dialkylarylphosphite, especially didecylphenylphosphite or didodecylphenylphosphite and/or a metaldialkyldithiophosphate.

The sulfur containing substance preferably is contained in the lubricant or lubricant concentrate of the invention in an amount of from 0,5 to 10% by weight, expecially 1 to 3% by weight, while it contains the phosphorus containing substance preferably in an amount of 0,1 to 10% by weight, in particular in an amount of 0,1 to 5% by weight, especially 0,5 to 2% by weight.

According to a further preferred embodiment of the invention the lubricant or lubricant concentrate can contain usual antioxidants, metaldeactivators, detergents, dispersants, antifoam agents and/or viscosity index improving agents.

The additives of the invention can be added as single compounds or in the form of a composition as a concentrate to the base medium (base oil or base fat) in the above stated amounts.

Further features and advantages of the invention can be seen from the following description of the invention. The polyolether compounds having at least one quaternary carbon atom in the molecule and which are preferably used according to the present invention can comprise the following groups of compounds:

a) mono-, di- and tripentaerythritol ethers and their ethoxylated ether derivatives The basic mono- and dipentaerythritol has the following structure

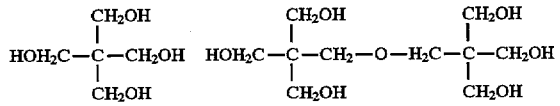

monopentaerythritol dimentaerythritol wherein the hydroxyl groups are etherified in part or completely and the ether groups thereof preferably contain straight or branched alkyl, aralkyl or aryl groups having 6 to 18, preferably 8 to 12 carbon atoms.

These compounds can be easily prepared and many representatives of these compounds are commercially available.

Examples for suitable pentaerythritol ethers are pentaerythritol monohexylether, pentaerythritol monooctylether, pentaerythritol monononylether, pentaerythritol monodecylether, pentaerythritol monododecylether, pentaerythritol-monomyristylether, pentaerythritol monohexadecylether, pentaerythritol monostearylether, pentaerythritol monooleylether, pentaerythritol monoisostearyl- and -isopalmitic acid ether; the corresponding dihexyl-, dioctyl-, dinonyl-, didecyl-, didodecyl-, dimyristyl-, dihexadecyl-, distearyl-, dioleyl-, diisostearyl- and diisopalmitic acid ether of pentaerythritol;, the corresponding trihexyl-, trioctyl-, trinonyl-, tridecyl-, tridodecyl-, trimyristyl-, trihexadecyl-, tristearyl-, trioleyl-, triisostearyl- and triisopalmitic acid ether of pentaerythritol as well as the corresponding tetrahexyl-, tetraoctyl-, tetranonyl-, tetradecyl-, tetradodecyl-, tetramyristyl-, tetrahexadexyl-, tetrastearyl-, tetraoleyl-, tetraisostearyl- and tetraisopalmitic acid ether of pentaerythritol.

b) pentaerythritol telomeric acid derivatives having the following skeleton:

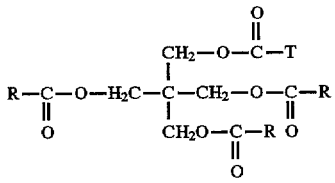

wherein T is telomer

R is T or alkyl.

The telomeric acids are compounds having a relatively high molecular weight and having long-chained star-like branched structures which can be etherified in the usual manner and the ethers thereof are valuable lubricants.

Mineral oils which can be used according to the invention are all usual mineral oils ranging from the isoparaffin oil having a viscosity of 1,0 mPa.s at 20° C. over thin spindle oil having a viscosity of 12 mPa.s at 20° C. to the high viscous brightstock and cylinder oil having a viscosity of 540 mPa.s at 50° C.

Many of the synthetic oils usable according to the invention are commercially available, f.i. from BP Co. under the tradename "Hyvis 10" (a polyisobutylene having a viscosity of 200 mPa.s at 100° C.), "Hyvis 200" (a polyisobutylene having a viscosity of 4300 mPa.s at 100° C.) and "Hyvis 2000" (a polyisobutylene having a viscosity of 43 000 mPa.s at 100° C.). Viscoplex 4-95 of Röhm Co. (a polymethacrylate) having a viscosity of 1000 mPa.s .at 100° C., Ucolub N9 having a viscosity of 5,7 mPa.s at 100° C., Ucolub N36A having a viscosity of 5,7 mPa.s at 100° C., Ucolub N36A having a viscosity of 18 mPa.s at 100° C., Ucolub N120A having a viscosity of 55 mPa.s at 100° C. (these all are water insoluble polyglycols) of Union Carbide Co. as well as "Isopar J" of Esso Co. (an isoparaffin oil) having a viscosity of 1,0 mPa.s at 20° C.

The phosphor containing substances which can be used according to the invention are organophosphorus compounds of the formula

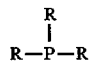

wherein R each is a straight or branched or cyclic alkyl group having 6 to 12 carbon atoms or a phenyl group substituted in o- or p-position by a lower alkyl group having 1 to 6 carbon atoms.

Preferred examples of the organophosphorus compounds having the above formula are monodecyl-diphenylphosphite, didecylphenylphosphite, triphenylphosphite, dioctyl-phenyl-phosphite, dihexyl-phenyl-phosphite, diisodecyl-phenyl-phosphite, diisooctyl-phenyl-phosphite, didecyl-o-methyl-phenylphosphite and didecyl-p-methylphenylphosphite.

The metaldialkyldithiocarbamates which can be used according to the invention as sulfur containing substance are compounds of the formula

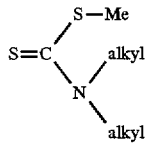

wherein Me is a metal selected from the group copper (Cu), silver (Ag), zinc (Zn), cadmium (Cd), titanium (Ti), boron (B), zirconium (Zr), tin (Sn), lead (Pb), vanadium (V), tantalum (Ta), antimony (Sb), chromium (Cr), molybdenum (Mo), tungsten (W), manganese (Mn), cobalt (Co), and nickel (Ni), preferably boron (B), nickel (Ni), cobalt (Co) or molybdenum (Mo).

The metaldialkyldithiophosphates which can be used according to the invention as sulfur containing substance as well as phosphorus containing substance are compounds of the formula

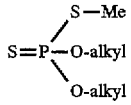

wherein Me is a metal selected from the group copper (Cu), silver (Ag), zinc (Zn), cadmium (Cd), titanium (Ti), boron (B), zirconium (Zr), tin (Sn), lead (Pb), vanadium (V), tantalum (Ta), antimony (Sb), chromium (Cr), molybdedum (Mo), tungsten (W), manganese (Mn), cobalt (Co), and nickel (Ni), preferably zinc (Zn), nickel (Ni), titanium (Ti), vanadium (V), molybdenum (Mo), tungsten (W) and manganese (Mn).

The alkyl groups Of the above-mentioned metaldialkyldithiocarbamates and metaldialkyldithiophosphates each preferably contain 4 to 8 carbon atoms, so that the named metal salts are still soluble in the commercially available base oils. Examples of the particularly advantageous alkyl groups are the n-, i- and tert-butyl group, the n- and i-amyl groups, the n- and i-hexyl group, the n- and i-heptyl group and the 2-ethylhexyl group. Especially preferred are the i-butyl group, the n- and i-amyl group and the 2-ethylhexyl group. Examples for metal dialkyldithiocarbamates which can advantageously be used according to the invention are the following: copper-dialkyldithiocarbamate and copper-bis-dialkyidithiocarbamate, silver-dialkyldithiocarbamate, zinc- and cadmium-bis-dialkyldithiocarbamates, boron-trisdialkyldithiocarbamates, titanium-, zirconium-, tin- and lead-tetrakisdialkyldithioearbamates, as well as tin- and lead-bis-dialkyldithiocarbamates antimony-, vanadium-, tantalum-tris-dialkyldithiocarbamates, -tetrakis-, and -pentakisdialkyldithiocarbamates, as well as the dialkyldithiocarbamates in which these metals are present in mixed degrees of oxidation; chromium-bis-, chromium-tris-, chromium-tetrakis-, and chromium-hexekisdialkylthiocarbamates, molybdenum-, and tungsten-tetrakis-, -hexakis-, and -oxybis- and -oxytetrakisdialkyldithiocarbamates, manganese-bis-, -tris-, -tetrakis- and -hexakisdialkyldithicarbamates- and cobalt- and nickel-bis- and -trisdialkyldithiocarbamates.

Among these compounds boron-trisdialkyldithiocarbamates, nickel-trisdialkyldithiocarbamates, molybdenum- tetrakis- and molybdenum-oxytetrakisdialkyldithiocarbamates, manganese-, vanadium-, and tungsten-tetrakisdialkyldithiocarbamates are particularly preferred. Metal dialkyldithiophosphates which can advantageously be used according to the invention are dialkyldithiophosphates of the same metals in the same degrees of oxidation as listed above for the metal dialkyldithiocarbamates.

Particularly advantageous ere zinc-bisdialkyldithiophosphates, nickel-bis- and -trisdialkyldlthiophosphates, titanium- and vanadium-tetrakisdialkyldithiophosphates, molybdenum- and tungsten-tetrakisdialkyldithiophosphates and molybdenum- and tungsten-oxytetrakisdialkyldithiophosphates. Particularly preferred representatives of the metal dialkyldithiocarbamates used according to the invention are: boron-trisdiisobutyldithiocarbamate, boron-trisdi-2-ethylhexyldithiocarbamate, nickel-trisdiisobutyldithioearbamate, nickel-trisdiamyldithiocarbamate, nickel-trisdi-2-ethylhexyldithiocarbamate, molybdenum-tetrakisdi-2-ethylhexyldithiocarbamate, molybdenum-oxytetrekidi-2-ethylhexyldlthiocarbamate, manganese-, vanadium- and tungsten-tetrakis-2-ethylhexyldithiocarbamate, as well as cobalt-bis-diisobutyldithiocarbamate.

Particularly preferred representatives of the metal dialkyldi-thiophosphates used according to the invention are zinc-bis-di-2-ethylhexyldithiophosphate, nickel-bis- and -trisdi-2-ethylhexyldithiophosphate, manganese-, titanium- and vanadium-tetrakisdi-2-ethylhexyldithiophosphate, as well as molybdenum-and tungsten-tetrakis- and molybdenum-and tungsten-oxytetrakisdi-2-ethylhexyldithiophosphate.

The invention will be explained in more detail using the following examples, however it is not restricted thereto.

In the following examples commercially available lubricating oils and lubricating fats, respectively, were used having the following composition and they were compared in regard to their lubricating properties which on the one hand contained the lubricant concentrate of the invention and on the other hand without containing it.

The results obtained in each example are depicted graphically in the diagrams.

For the carrying-out of the tests a circular plate of refined steel with a diameter of 23 mm and a thickness of 10 mm was used, onto the surface of which a drop of each lubricant or lubricant concentrate to be tested was applied. Onto the area where the drop of the lubricant or lubricant concentrate was located a ball made of the same refined steel with a diameter of 10 mm was applied, which on account of its load exerted a pressure onto the surface of the metal plate. The metal ball was moved to and fro on the surface of the metal plate with a frequency of 50 Hz over an amplitude of 1 mm for 60 to 180 minutes under pressure, whereby during the test the load within the range was varied from 50 to 300N and the temperature was varied from 50° to 150° C. (SRV (swing-friction-wear) apparatus which is sold world-wide by the firm Optimol GmbH).

The wear-profile produced on account of the friction between the loaded ball and the surface of the metal plate within the testing period diagonal to the oscillation direction of the ball was recorded by means of a suitable recording apparatus, whereby the below given diagrams were obtained, in which on the ordinate, the height of wear is plotted as difference between the highest and lowest point of the surface profile of the metal plate, against the scanning span of the surface of the metal plate on the abscissa.

In the below diagrams a depth of profile on the ordinate of 1 cm corresponds to a real depth of profile on the surface of the metal plate of 1 μm, whereas in the diagram B' of example 2 the scanner was so damped that a depth of profile of 1 cm on the diagram corresponds to a real depth of profile on the surface of the plate of 2,5 μm.

The diagrams were recorded under identical conditions (load of the ball 50 to 300N, friction frequency 50 Hz, temperature 50° to 150° C., friction amplitude 1 mm, testing time 1 to 3 hours).

The friction coefficients indicated below the diagrams ($R_k$max=maximum friction coefficient; $R_k$d=average friction coefficient over 98% of the friction coefficient curve) were also determined by using the above described SRV apparatus. In all tests where not stated otherwise as lubricant concentrate of the invention a product having the following composition was used:

50% $C_{10}$–$C_{18}$-pentaerythritolether having a quaternary carbon atom
20% copolymer of α-olefin esters
9,5% trimethyladipic acid didecylester
2,5% dialkylarylphosphite
9% metaldialkyldithiophosphate/metaldialkyldithiocarbamate
7% thiazole derivative
2% sterically hindered phenol as oxidation inhibitor

EXAMPLE 1

A high viscous lubricating oil having a viscosity of 2200 mPa.s at 50° C. and having the following composition was prepared and tested:

| | |
|---|---|
| trimethyladipic acid didecylester | 34% |
| polyisobutylene (43000 mPa · s/100° C.) | 32% |
| lubricant-entraining substance | 6% |
| lubricant concentrate of the invention | 28% |

In the comparative product the lubricant concentrate of the invention was omitted.

Both products were tested for 1 h at a temperature of 150° C. and a load of 200N under identical conditions. The obtained results are graphically depicted in the following diagrams A (according to the invention) and A' (according to the state of art).

The addition of the lubricant concentrate of the invention led to a depth of profile of 1,13 μm (average of two determinations). Without the addition of the lubricant concentrate of the invention a depth of profile of 1,68 μm average of two determinations) was obtained.

EXAMPLE 2

An intermediate viscous lubricating oil having a viscosity of 190 to 200 mPa.s at 50° C. and having the following composition was obtained.

| prepared and tested: | |
|---|---|
| polymeric α-olefin esters | 12% |
| trimethyladipic acid didecylester | 36% |
| polyisobutylene (43000 mPa · s/100° C.) | 18% |
| lubricant-entraining substance | 6% |
| lubricant concentrate of the invention | 28% |

In the comparative product the lubricant concentrate of the invention was omitted.

Both products were tested for 1 h at a temperature of 150° C. and a load of 200N under identical conditions. The obtained results are graphically depicted in the following diagrams B (according to the invention) and B' (according to the state of art).

The addition of the lubricant concentrate of the invention led to a depth of profile of 0,90 μm (average of two determinations). Without the addition of the lubricant concentrate of the invention a depth of profile of 13,98 μm (average of two determinations) was obtained.

EXAMPLE 3

An intermediate viscous lubricating oil having a viscosity of 120 to 150 mPa.s at 50° C. and having the following composition was prepared and tested:

| | |
|---|---|
| high viscous α-olefin ester copolymer | 4% |
| intermediate viscous α-olefin ester polymer | 12% |
| trimethyladipic acid didecylester | 34% |
| polyisobutylene (200 mPa · s/100° C.) | 12% |
| lubricant-entraining substance | 6% |
| lubricant concentrate of the invention | 32% |

In the comparative product the lubricant concentrate of the invention was omitted.

Both products were tested for 1 h at a temperature of 150° C. and a load of 200N under identical conditions. The obtained results are graphically depicted in the following diagrams C (according to the invention) and C' (according to the state of art).

The addition of the lubricant concentrate of the invention led to a depth of profile of 1,03 μm (average of two determinations). Without the addition of the lubricant concentrate of the invention a depth of profile of 3,48 μm (average of two determinations) was obtained.

EXAMPLE 4

A high viscous adhering and high temperature lubricating oil having a viscosity of 15 000 mPa.s at 50° C. and having the following composition was prepared and tested:

| | |
|---|---|
| trimethyladipic acid didecylester | 29% |
| polyisobutylene (43000 mPa · s/100° C.) | 52% |
| lubricant concentrate of the invention | 19% |

In the comparative product the lubricant concentrate of the invention was omitted.

Both products were tested for 1 h at a temperature of 150° C. and a load of 200N under identical conditions. The obtained results are graphically depicted in the following diagrams D (according to the invention) and D' (according to the state of art).

The addition of the lubricant concentrate of the invention led to a depth of profile of 0,87 μm (average of three determinations). Without the addition of the lubricant concentrate of the invention a depth of profile of 1,57 μm (average of two determinations) was obtained.

EXAMPLE 5

A high duty gear oil SAE 85/90 was tested with and without the additive of the invention consisting of 10% by weight of monopentaerythritol tetraester.

Both products were tested for 1 h at a temperature of 90° C. and a load of 200N under identical conditions. The obtained results are graphically depicted in the following diagrams E (according to the invention) and E' (according to the state of art).

The addition of the additive of the invention led to a depth of profile of 0.85 μm (average of two determinations). Without the addition of the additive of the invention a depth of profile of 1,02 μm (average of two determinations) was obtained.

EXAMPLE 6

A lubricating fat for multi-purpose lubrication for high duty gears and synchronizing joints having the following composition was prepared and tested:

| | |
|---|---|
| mineral oil | 70% |
| consistency improving agent on lithium-stearate basis | 9% |
| lubricant concentrate of the invention | 21% |

In the comparative product the lubricant concentrate of the invention was replaced by 3% by weight of a molybdenum disulfide/graphite mixture.

Both products were tested for 3 h at a temperature of 50° C. and a load of 300N under identical conditions. The obtained results are graphically depicted in the following diagrams F (according to the invention) and F' (according to the state of art).

The addition of the lubricant concentrate of the invention led to a depth of profile of 0,95 μm (average of three determinations), while the addition of the comparative additive mixture led a depth of profile of 1,63 μm (average of three determinations)

While the invention was explained above in more detail referring to preferred specific emobdiments, it is however obvious that it is not restricted thereto, but that it can be altered and modified in many respects in a manner obvious to the expert, without going beyond the scope of the present invention.

I claim:

1. A lubricant comprising:

(a) an oil base selected from the group consisting of natural oil, synthetic oil and mixtures thereof;

(b) at least one tetravalent to octavalent alcohol derivative having density ($d_{20}$) of at least 0.900 and containing at least one quaternary carbon atom in its molecule said alcohol being selected from the group consisting of mono-, di-, and tripentaerythritols, all of the alcoholic groups of which are etherified by an alkyl or aryl halide containing a straight or branched alkyl, aralkyl or aryl group having 6 to 18 carbon atoms;

(c) a sterically hindered phenol;

(d) at least one dialkyldithiocarbamate compound having the formula

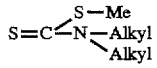

where Me is selected from the group consisting of B, V, Cr, Mo, W, Mn, Co, Ni and mixtures thereof and wherein each alkyl is an alkyl group having 4 to 8 carbon atoms, (e) at least one compound selected from the group consisting of dialkylaryl-, monoalkyldiaryl-, trialkyl- and triarylphosphite, wherein the alkyl group is straight, branched or cyclic and contains 8 to 12 carbon atoms and the aryl group is a phenyl group substituted in the o- or p- position by an alkyl group having 1 to 6 carbon atoms;

(f) a thiazole, wherein said component (b) is present in an amount of from 0.1 to 40% by weight, said component (d) present in a weight amount of from 0.1 to 10% by weight, said component (e) present in an amount of from 0.1 to 5% by weight, said component (f) present in an amount of from 0.1 to 5% by weight, wherein said percent weight amounts are based on the weight of component (a);

(g) at least one dialkyldithiophospate compound of general formula

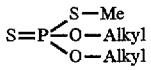

wherein Me is selected from the group consisting of Zn MO, oxy-mo, and mixtures thereof and alkyl is an alkyl group having 4 to 8 carbon atoms; and (h) an additive selected from antioxidants, metal deactivators, detergents, dispersants, antifoam agents and viscosity index improving agents, wherein said additive is different from any of components (a)–(g).

2. The lubricant according to claim 1, wherein the total amount of components (d), (e) and (g) ranges from 0.3 to 10% by weight based on the weight of component (a).

3. The lubricant according to claim 2, wherein components (d), (e) and (g) combined are present in an amount of from 0.3 to 5% by weight based on the weight of component (a).

4. The lubricant according to claim 3, wherein said components (d), (e) and (g) combined are present in an amount of from 0.3 to 2% by weight based on the weight of component (a).

5. The lubricant according to claim 1, wherein component (d) is selected from the group consisting of the dialkyldithiocarbamates of boron, nickel, cobalt and molybdenum and mixtures thereof and component (g) is selected from the group consisting of the dialkyldithiophosphates of zinc and molybdenum and mixtures thereof.

6. The lubricant according to claim 5 wherein component (d) comprises (i) a compound selected from the group consisting of boron-tris-diisobutyldithiocarbamate and boron-tris-di-2-ethylhexyldithiocarbamate and mixtures thereof in combination with (ii) a compound selected from the group consisting of nickel-tris-diisobutyldithiocarbamate, nickel-tris-diamyldithiocarbamate and nickel-tris-di-2-ethylhexyldithiocarbamate and mixtures thereof, and component (g) is selected from the group consisting of zinc-bis-di-2-ethylhexyldithiophosphate, molybdenum-tetrakis-di-2-ethylhexyldithiophosphate and molybdenumoxytetrakis-di-2-ethylhexyldithiophosphate and mixtures thereof.

7. The lubricant according to claim 1, wherein said component (b) is present in an amount of from 0.1 to 20% by weight based on the weight of component (a).

8. The lubricant according to claim 7, wherein said component (b) is present in an amount of from 1 to 12% by weight based on the weight of component (a).

9. The lubricant according to claim 8, wherein said component (b) is present in an amount of from 2 to 6% by weight based on the weight of component (a).

10. The lubricant according to claim 1, wherein said oil base has a viscosity in the range of from 0. 1 to 2,000,000 mPa.s at 20° C.

11. The lubricant according to claim 1, wherein component (f) is present in an amount of from 1 to 3% by weight based on the weight of component (a).

12. The lubricant according to claim 1 wherein component (e) is present in an amount of from 0.5 to 2% by weight based on the weight of component (a).

13. The lubricant according to claim 1, wherein component (d) is present in an amount of from 0.1 to 5% by weight based on the weight of component (a).

14. The lubricant according to claim 13, wherein component (d) is present in an amount of from 0.1 to 3% by weight based on the weight of component (a).

15. The lubricant according to claim 1, wherein said synthetic oil is selected from the group consisting of aromatic and aliphatic dicarboxylic acid esters and mixtures thereof.

16. The lubricant according to claim 15, wherein said synthetic oil is a poly-α-olefin-dicarboxylic acid ester having a molecular weight in the range of from 1,000 to 3,000.

17. The lubricant according to claim 1, wherein said synthetic oil is selected from the group consisting of phthalic acid diisodecylester, trimethyladipic acid didecylester, sebacic acid dioctylester, a polyisobutylene having a molecular weight of from 1000 to 100,000 and a viscosity of from 200 to 43,000 mPa.s at 100° C., a polymethacrylate having a viscosity of 1000 mPa.s at 100° C., a water insoluble polyglycol having a viscosity of from 6 to 60 mPa.s at 100° C., an isosparaffine oil, and an alkyl benzene having a flash point of higher than 50° C. and a viscosity in a range of from 1.0 to 2,000,000 mPa.s at 20° C., and a telomeric acid ester.

18. The lubricant of claim 1, wherein said natural oil is a mineral oil.

19. A lubricant comprising:

(a) an oil base selected from the group consisting of natural oil, synthetic oil and mixtures thereof;

(b) at least one tetravalent to octavalent alcohol derivative having density ($d_{20}$) of at least 0.900 and containing at least one quaternary carbon atom in its molecule, said alcohol being selected from the group consisting of mono-, di-, and tripentaerythritols, all of the alcoholic groups of which are ethoxylated by ethylene oxide and then etherified by an alkyl or aryl halide containing a straight or branched alkyl, aralkyl or aryl group having 6 to 18 carbon atoms;

(c) an anti-oxidant compound having at least one free hydroxyl group on its molecule;

(d) at least one dialkyldithiocarbamate compound having the formula

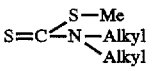

where Me is selected from the group consisting of B, V, Cr, Mo, W, Mn, Co and Ni, and wherein each alkyl is an alkyl group having 4 to 8 carbon atoms;

(e) at least one compound selected from the group consisting of dialkylaryl-, monoalkyldiaryl-, trialkyl- and triarylphosphite, wherein the alkyl group is straight, branched or cyclic and contains 8 to 12 carbon atoms and the aryl group is a phenyl group substituted in the O- or p- position by an alkyl group having 1 to 6 carbon atoms; and (f) a thiazole, wherein said component (b) is present in an amount of from 0.1 to 40% by weight, said component (d) present in an amount of from 0.1 to 10% by weight, said component (e) present in an amount of from 0.1 to 5% by weight, said component (f) present in an amount of from 0.1 to 5% by weight, wherein said percent weight amounts are based on the weight of component (a).

20. Lubricant comprising:

(a) a polyglycol oil base;

(b) at least one tetravalent to octavalent alcohol derivative having a density ($d_{20}$) of at least 0.900 and containing at least one quaternary carbon atom in its molecule, said alcohol being selected from the group consisting of mono-, di-, and tripentaerythritols, all the alcoholic groups of which are ethoxylated by ethylene oxide and then etherified by an alkyl or aryl halide containing a straight or branched alkyl, aralkyl or aryl group having 6 to 18 carbon atoms;

(c) at least one dialkyldithiocarbamate compound having the formula

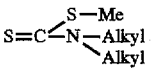

where Me is selected from the group consisting of B, V, Cr, Mo, W, Mn, Co and Ni, and wherein each alkyl is an alkyl group having 4 to 8 carbon atoms;

(d) at least one compound selected from the group consisting of dialkylaryl-, monoalkyldiarylo, trialkyl- and triarylphosphite, wherein the alkyl group is straight, branched or cyclic and contains, 8 to 12 carbon atoms and the aryl group is a phenyl group substituted in the o- or p- position by an alkyl group having 1 to 6 carbon atoms, and (e) a thiazole, wherein said component (b) is present in an amount of from 0.1 to 40% by weight, said component (c) present in a weight amount of from 0.1 to 10%, said component (d) present in a weight amount of from 0.1 to 5%, said component (e) present in a weight amount of from 0.1 to 5%, wherein said percent weight amounts are based on the weight of component(a).

21. Lubricant comprising:

(a) a polyglycol oil base, (b) at least one tetravalent to octavalent alcohol derivative having a density ($d_{20}$) of at least 0.900 and containing at least one quaternary carbon atom in its molecule, said alcohol being selected from the group consisting of mono-, di- and tripentaerythritols, all the alcoholic groups of which are etherified by an alkyl or aryl halide containing a straight or branched alkyl, aralkyl or aryl group having 6 to 18 carbon atoms;

(c) at least one dialkyldithiocarbamate compound having the formula

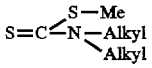

where Me is selected from the group consisting of B, V, Cr, Mo, W, Mn, Co and Ni, and mixtures thereof, and wherein each alkyl is an alkyl group having 4 to 8 carbon atoms;

(d) at least one compound selected from the group consisting of dialkylaryl-, monoalkyldiaryl-, trialkyl- and triarylphosphite, wherein the alkyl group is straight, branched or cyclic and contains 8 to 12 carbon atoms and the aryl group is a phenyl group substituted in the o- or p- position by an alkyl group having 1 to 6 carbon atoms, and (e) a thiazole, wherein said component (b) is present in an amount of from 0.1 to 40% by weight, said component (c) present in a weight amount of from 0.1 to 10%, said component (d) present in a weight amount of from 0.1 to 5%, said component (e) present in a weight amount of from 0.1 to 5%, wherein said percent weight amounts are based on the weight of component (a).

22. The lubricant according to claim 21, further comprising (f) at least one dialkyldithiophosphate compound of general formula

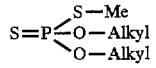

where Me is selected from the group consisting of Zn MO, oxy-mo, and mixtures thereof, and Alkyl is an alkyl group having 4 to 8 carbon atoms.

23. The lubricant according to claim 20, further comprising:

(g) antioxidants, metal deactivators, detergents, dispersants, antifoam agents or viscosity index improving agents, wherein said antioxidants, metal deactivators, detergents dispersants, antifoam agents or viscosity index improving agents are different from any of the components (a)–(f).

24. The lubricant of claim 22, wherein the total amount of components (c), (d) and (f) ranges from 0.3 to 10% by weight based on the weight of component (a).

25. The lubricant according to claim 24, wherein components (c), (d) and (f) combined are present in an amount of from 0.3 to 5% by weight based on the weight of component (a).

26. The lubricant according to claim 25, wherein components (c), (d) and (f) combined are present in an amount of from 0.3 to 2% by weight based on the weight of component (a).

27. The lubricant according to claim 22, wherein component (c) is selected from the group consisting of the diakyldithiocarbamates of baron, nickel, cobolt and molybdenum and mixtures thereof and component (f) is selected from the group consisting of the dialkyldithiophosphates of zinc, and molybdenum, and mixtures thereof.

28. The lubricant according to claim 27, wherein component (c) comprises (i) a compound selected from the group consisting of boron-tris-diisobutyldithiocarbamate and boron-tris-di-2-ethylhexyldithiocarbamate and mixtures thereof in combination with (ii) a compound selected from the group consisting of nickel-tris-diisobutyldithiocarbamate, nickle-tris-diamyldithiocarbamate and nickel-tris-di-2-ethylhexyldithiocarbamate and mixtures thereof, and component (f) is selected from the group consisting of zinc-bis-di-2-ethylhexyldithiophosphate, molybdenum-tetrakis-, di-2-ethylhexyldithiophosphate, and molybdenum-oxytetrakis-, di-2-ethylhexyldithiophosphate, and mixtures thereof.

29. The lubricant according to claim 21, wherein said component (b) is present in an amount of from 0.1 to 20% by weight based on the weight of component (a).

30. The lubricant according to claim 29, wherein said component (b) is present in an amount of from 1 to 12% by weight based on the weight of component (a).

31. The lubricant according to claim 30, wherein said component (b) is present in an amount of from 2 to 6% by weight based on the weight of component (a).

32. The lubricant according to claim 21, wherein said oil base has a viscosity in the range of from 0.1 mPa.s to 2,000,000 mPa.s at 20° C.

33. The lubricant according to claim 21, wherein component (e) is present in an amount of from 1 to 3% by weight based on the weight of component (a).

34. The lubricant according to claim 21, wherein component (d) is present in an amount of from 0.5 to 2% by weight based on the weight of component (a).

35. The lubricant according to claim 21, wherein component (c) is present in an amount of from 0.1 to 5% by weight based on the weight of component (a).

36. The lubricant according to claim 35, wherein component (c) is present in an amount of from 0.1 to 3% by weight based on the weight of component (a).

* * * * *